United States Patent [19]

Graham et al.

[11] 4,179,866

[45] Dec. 25, 1979

[54] CASE PACKER

[75] Inventors: Robert H. Graham; Jerald R. McBride, both of Spokane, Wash.

[73] Assignee: R. A. Pearson Company, Spokane, Wash.

[21] Appl. No.: 892,664

[22] Filed: Apr. 3, 1978

[51] Int. Cl.[2] ..... B65B 43/39; B65B 5/06

[52] U.S. Cl. ..... 53/468; 53/242; 53/284; 53/374

[58] Field of Search ..... 53/468, 242, 243, 284, 53/374, 541

[56] References Cited

U.S. PATENT DOCUMENTS

| | | | |
|---|---|---|---|
| 3,605,377 | 9/1971 | Sabel | 53/242 X |
| 4,083,165 | 4/1978 | Maldina | 53/541 |

*Primary Examiner*—Travis S. McGehee

*Attorney, Agent, or Firm*—Wells, St. John & Roberts

[57] ABSTRACT

A case packer for placement of loads through the bottom of a carton so as to accommodate loads of a type which cannot be dropped or placed into a carton from above or from the side. The apparatus includes a support plate mechanism mounted for elevational movement and supplied with individual case loads by a case conveyor. The cases themselves are delivered sequentially to a case packing station by a case conveyor. The plate mechanism is movable upwardly to locate the load within the downwardly open case. Flap engaging elements then fold opposed flaps beneath the plate mechanism and provide elevational support to the case and load within it. Plate shift means spreads the plate mechanism laterally from a position located between the load and the folded flaps to a position clear of the flaps. The plate mechanism can then be sequentially moved downward to clear the case before it moves outward from the case packing station.

8 Claims, 13 Drawing Figures

CASE PACKER

BACKGROUND OF THE INVENTION

This invention relates to the packing of cases, such as corrugated cardboard cartons, in a bottom loading sequence. Such an operation involves the insertion of a load into a carton through lower open flaps, rather than from above the carton or from the side, as in most conventional case packing operations. Conventional methods of case loading are often undesirable due to the nature of the loads involved, which can be either too fragile to risk accidental dropping and damage or are too unstable to permit grasping and moving of the load from above or from the side. As an example, the present apparatus and method were designed specifically for loading of folded computer printout forms, which are accordion pleated in a vertical stack comprising a continuous ribbon of paper. Such a load cannot be grasped from above, due to its very nature as a continuous strip of paper. It also is very unstable and likely to slip from one side to the other if not handled carefully during packing of a case. The solution to these problems has been the development of a mechanism and method for bottom loading of a case with the load supported on movable support plates that transfer the load directly to subsequently sealed interior flap surfaces of the receiving case.

The following description relates to the packing mechanism itself, and is used in conjunction with other mechanisms and devices of known construction. Specifically, the apparatus is used in combination with a carton delivery and expanding apparatus which feeds individual collapsed rectangular cartons to a conveyor mechanism in an expanded or erected configuration. An example of such an apparatus is disclosed in detail in U.S. Pat. No. 3,739,696 to Pearson, which is hereby incorporated by reference.

DESCRIPTION OF THE DRAWINGS

FIG. 8 is a schematic side elevation view;

FIG. 9 is a second schematic side elevation view;

FIG. 10 is a third schematic side elevation view;

FIG. 11 is a schematic transverse elevation view;

FIG. 12 is a transverse schematic elevation view showing the blue application step; and FIG. 13 is a schematic transverse elevation view showing final sealing of the case.

DESCRIPTION OF A PREFERRED EMBODIMENT

Figure 1:
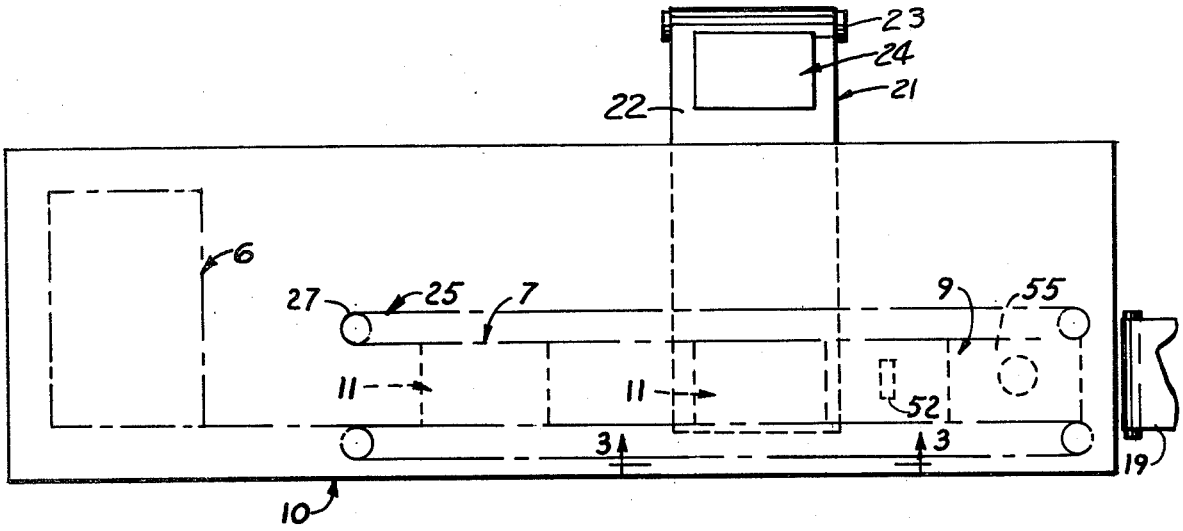
FIG. 1 is a simplified plan view of the apparatus.

This invention relates to a packing apparatus and method designed to fill a succession of open cases by placing a load within each case and sealing the case flaps in a bottom loading procedure. This particular procedure involves the placing of a load into the case through the bottom of the case, and subsequent closing of the bottom flaps and sealing thereof to complete the case packing operation.

The case itself is designated generally in the drawings by the reference numeral 11. It typically comprises a conventional rectangular case or carton made of paperboard, corrugated board or other suitable material. The case 11 includes upright side walls 12 and end walls 13 which are perpendicular to one another when the case 11 has been expanded or erected. The top portions of case 11 include folded top side flaps 14 and top end flaps 15. The open case 11 is provided also with opposed lower side flaps 16 and front and rear flaps 17, 18 which depend downwardly from the upright walls 12, 13. The side front and rear flaps 16, 17, 18 depend downwardly along coplanar bottom fold lines 20 which join the respective flaps to the walls 12 or 13.

In describing the apparatus for packing and completing the case 11, reference will be made to directions as they relate to movement of the case itself. Thus, the path of movement of case 11 along the apparatus will be termed a longitudinal path and elements or procedures arranged across that longitudinal path will be termed transverse to it. The direction of movement of case 11 as shown in the drawings is either from left to right, in the case of the side elevation views, or into the paper in case of the transverse elevation views. The left end of the case 11 as illustrated shall be termed its rear end and the right end shall be termed its front end. As shown, the case 11 is initially erected with the walls 12, 13 in vertical positions and the planar lower fold lines 20 in a horizontal position.

The apparatus is supported on a rigid framework generally designated in the drawings by the numeral 10. It is to be understood that the disclosure of framework 10 is detailed only as necessary for general reference purposes. Specific elements of framework 10 have been broken away in the various drawings in order to permit adequate illustration of the movable elements with which this disclosure is particularly concerned.

The illustrated load 24 is shown as the general outline of a stack of paper folded accordion style as a continuous strip. Such a stack or load 24 typically has a concave upper surface due to the folds at the opposite end edges of each layer. It is quite unstable and subject to slippage along the various layers thereof. It poses a substantial challenge with respect to machine handling and packing. The load 24 is supplied to the apparatus by conventional load conveying means 21 in the form of a conveyor belt 22 entrained about pulleys 23 for support and power. The individual loads 24 are fed along belt 22 in a timed relation to properly deposit each load 24 at the apparatus in the manner described below. Such conveyors and timing arrangements are well known in the packaging industry.

Figure 2:
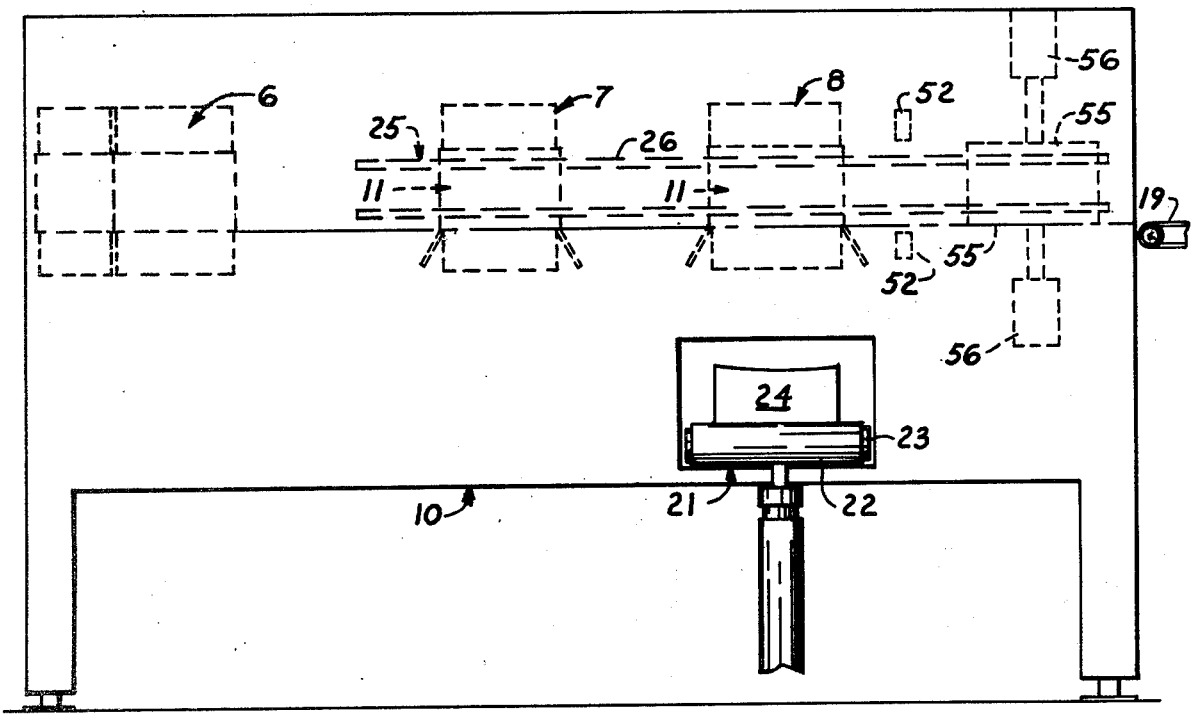
FIG. 2 is a simplified elevational view of the apparatus.

The individual cases 11 are moved through the apparatus in four basic stages schematically illustrated in FIGS. 1 and 2. They are first stored as a group within a hopper or supply station 6, which receives incoming cases 11 in a flattened vertical condition. They are mechanically fed from supply station 6 in an individual fashion by a suitable carton expanding apparatus such as that disclosed in U.S. Pat. No. 3,739,696, noted above. The horizontally expanded cartons are then fed between belts 26 of a case conveying means 25 which is intermittently powered and which stops each case 11 at a ready station 7. At this station 7, the top flaps 14, 15 can be completely folded and sealed, but are preferably partially folded, with the end flaps 15 within the confines of the side flaps 14, which are preferably folded inward at about a 45° angle as the case continues along the load conveyor conveying means 21.

The reference numeral 8 designates the case packing station whose elements are the basic subject matter of this disclosure and are shown in detail in the remaining drawings. Downstream from the case packing station 8 are glue applicators 52, which direct glue or adhesive to the upper and lower flap surfaces during movement of each case. Finally, a case sealing station 9 is provided to compress the load and flaps inwardly to complete the case structure. The finished and loaded cases are then received on a conveyor 19 for delivery as desired.

The four stages of case loading are: (a) supplying flattened cases for handling; (b) placing erected cases in a ready condition with their upper flaps at least partially folded and their lower flaps spread; (c) inserting the load and closing the lower flaps under it; and (d) sealing the carton flaps.

The apparatus by which the case 11 is filled or packed is shown in detail in FIGS. 3 through 7. This apparatus basically comprises a load handling mechanism shown in FIGS. 5 and 6, and a case handling mechanism shown in conjunction with the load handling mechanism in FIGS. 3 and 4.

Figure 5:
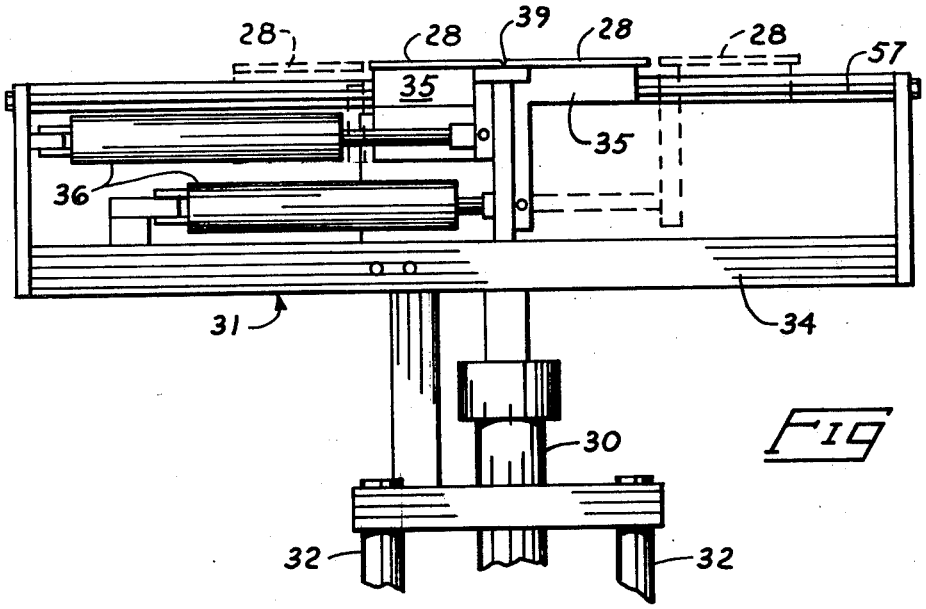
FIG. 5 is an enlarged fragmentary view taken along line 5—5 in FIG. 4.
Figure 6:
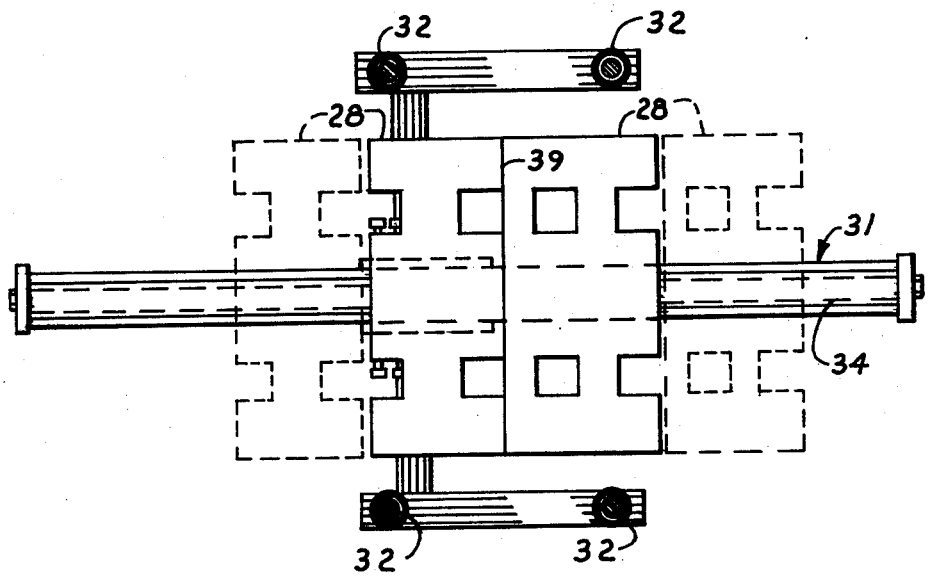
FIG. 6 is a top view of the apparatus as seen in FIG. 5.

Referring now to FIGS. 5 and 6, the load handling mechanism is built about a pair of thin horizontal plates 28. The plates 28 have complementary inner edges 39 which are centered along the longitudinal path of the cases 11 and are located vertically beneath the packing station 8. Plates 28 receive the individual loads 24 from the load conveying means 21. The load 24 rests directly on the upper surfaces of the two plates 28. Plates 28 are supported by elevator means in the form of a vertical cylinder 30. The elevator means is operably connected to plates 28 for selectively moving them between a lowered position beneath the packing station 8 and a raised position substantially coplanar with the bottom fold lines 20 of a case 11 at the packing station 8.

Interposed between the movable piston of the cylinder 30 and the plates 28 is a plate shift means 31. It includes a relatively narrow transverse center framework 34 fixed to the upper end of the cylinder piston rod. A transverse narrow guide 56 is fixed across the top of framework 34 and is slidably engaged by a pair of supports 35 fixed respectively to the undersides of the plates 28. A pair of cylinder assemblies 36 are connected between the framework 34 and the respective supports 35. They are operable in unison to move the plates 28 from their abutting center positions (shown in full lines in FIGS. 5 and 6) to their spaced or spread positions (shown in dashed lines). The plate shift thereby means selectively moves the plates 28 within a plane parallel to the bottom fold lines 20 of a case 11 at the packing station 8 between a first condition centered with respect to the case and a transversely spaced condition.

The plates 28 are vertically guided by fixed guide posts 32 which form a part of the basic machine framework 10. A stabilizing frame 33 is fixed to framework 34 and slides on bearings encircling the cylindrical posts 32. The lowered position of the elevator means is shown in full lines in FIG. 3. Its raised position is shown in full lines in FIG. 4.

Figure 3:
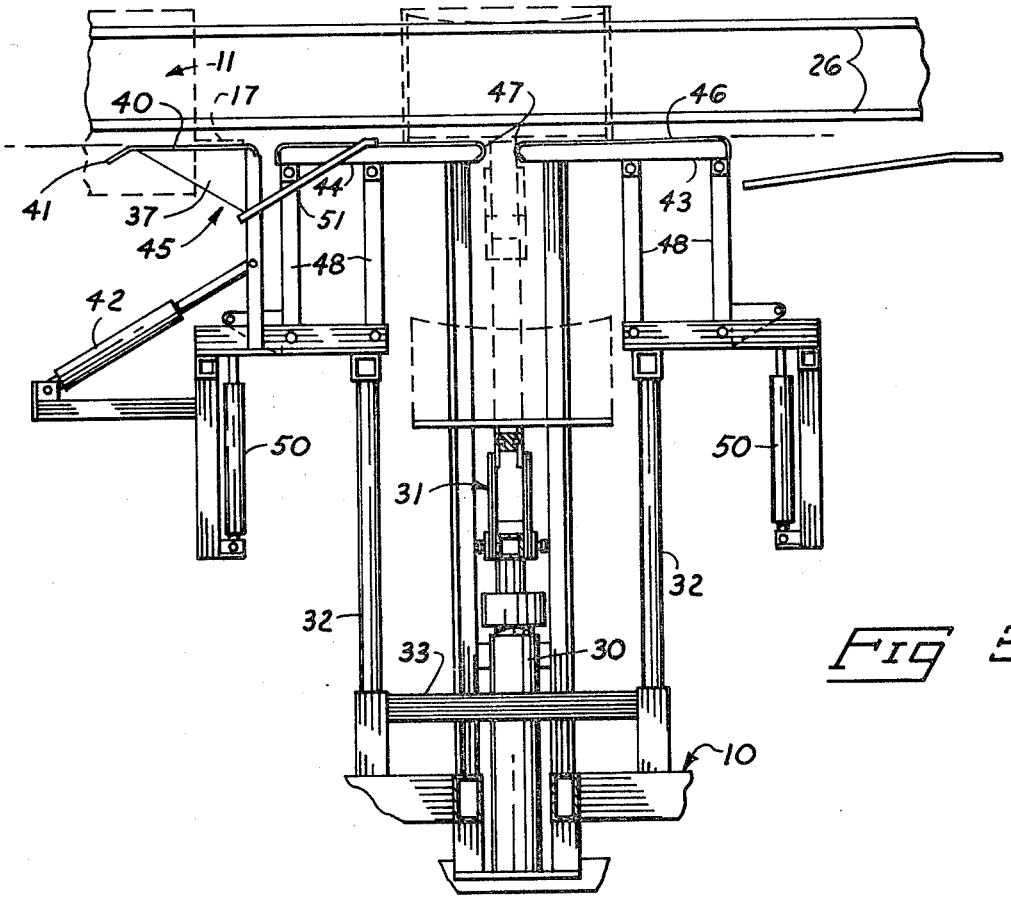
FIG. 3 is a fragmentary elevation view taken substantially along line 3—3 in FIG. 1.
Figure 4:
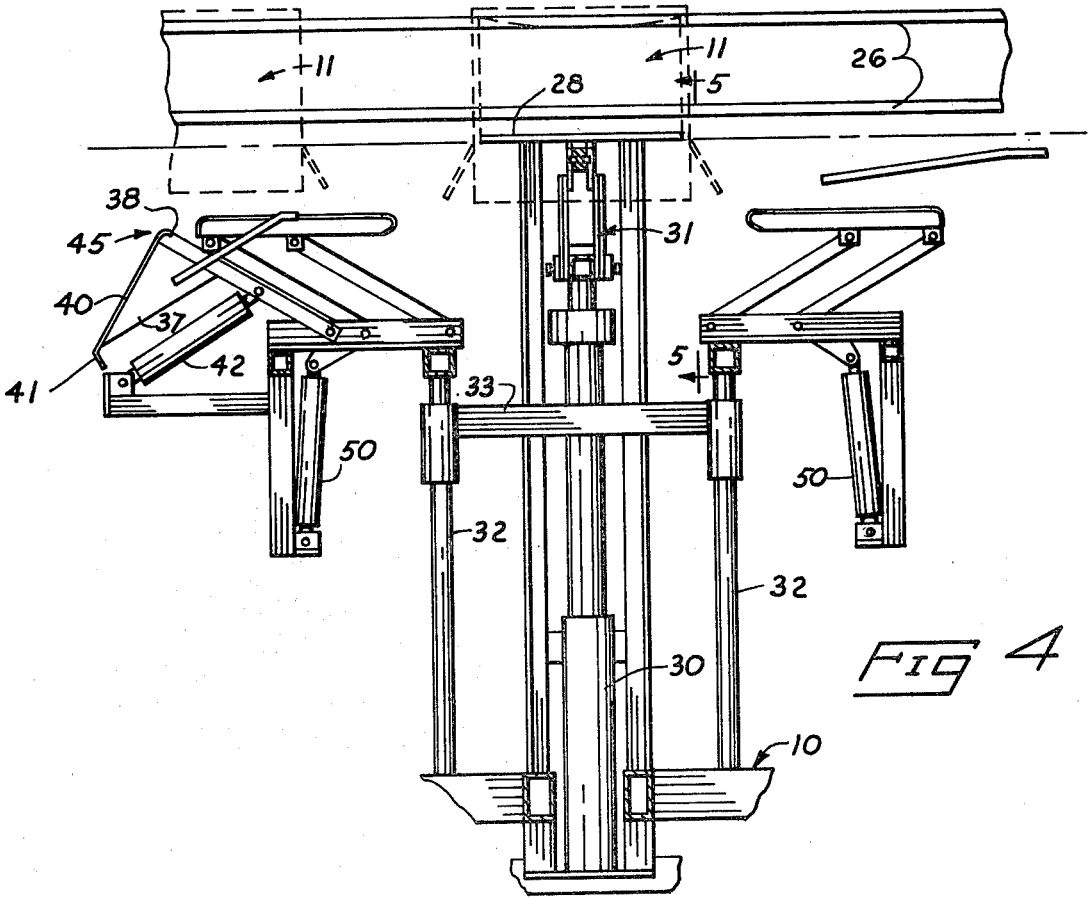
FIG. 4 is a view similar to FIG. 3, showing alternate positions of the illustrated mechanisms.

The case handling mechanism is shown in FIGS. 3 and 4. Each erected case 11 moving along the case conveying means 25 is gripped along its side walls 12 by opposed endless belts 26 which impart movement to the individual cases 11 through inwardly protruding pushing lugs 29. The belts 26 are conventionally entrained about support pulleys 27 on framework 10. While further fixed or movable guides might be mounted on framework 10 to support the various case elements, basic support is provided through the case conveying means 25 itself. Auxiliary supports have not been detailed in the drawings.

Each incoming erect case 11 is contacted by front and rear flap engaging means indicated generally by the reference numeral 45. The front and rear flap engaging means as illustrated comprises a flap folding element 37 that folds the front and rear flaps 17, 18 outward in readiness for the packing procedures; as well as a front flap engaging element 43 and a rear flap engaging element 44 which respectively close the front and rear flaps 17, 18 of a loaded case 11 at the packing station 8.

The flap folding element 37 engages the front flap 17 while each case 11 is at the ready station 7. FIG. 3 shows element 37 in its raised or upper position, with its upper surface 40 in contact with the forwardly protruding flap 17. The flap 17 is folded forward of the case as the element 37 is raised upward to engage it. Each flap 17 is first contacted by the upright 38, which pushes the flap 17 forward and upward from its normal vertical position. The rearwardly facing edge 41 across the flap folding element 37 subsequently folds the rear flap 18 to a similar horizontal position as it is traversed by the case 11 during movement of the case between the ready station 7 and the packing station 8.

The flap folding element 37 is moved between its lowered and raised positions by a cylinder assembly 42, which acts in conjunction with the cylinder assemblies for the flap engaging elements 43, 44.

The front and rear flap engaging elements 43, 44 are symmetrical across a transverse line centered with respect to a case 11 at the packing station 8. Since they are otherwise identical, corresponding reference numerals have been applied to their individual elements. Each flap engaging element includes an upper surface 46 and an inwardly facing nose 47. The elements 43, 44 are mounted by parallel support arms 48 and are moved between raised positions (FIG. 3) and lowered positions (FIG. 4) by individual cylinder assemblies 50. As previously noted, the cylinder assemblies 50 act simultaneously with the cylinder 42 to move the front and rear flap engaging means in unison relative to the framework 10.

Figure 7:
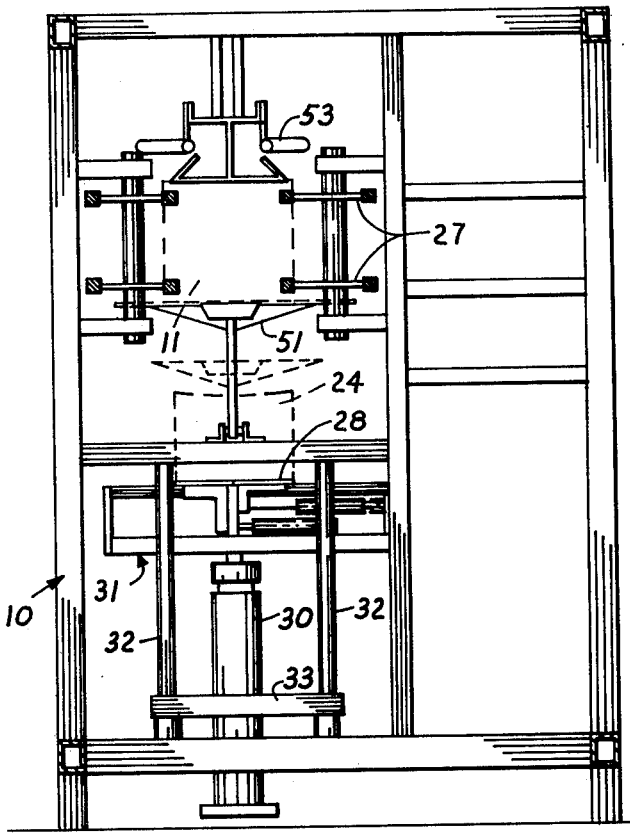
FIG. 7 is a transverse sectional view taken substantially from the left in FIG. 3.

The rear flap engaging element 44 has a transverse plow 51 fixed to it. As shown in FIG. 3 and FIG. 7, this plow 51 spreads the lower side flaps 16 as each case 11 approaches the packing station 8. Thus, the flaps 16, 17 and 18 are spread outward from the vertical walls of the case to facilitate entry of a load into the case through its open bottom end.

Figure 8:
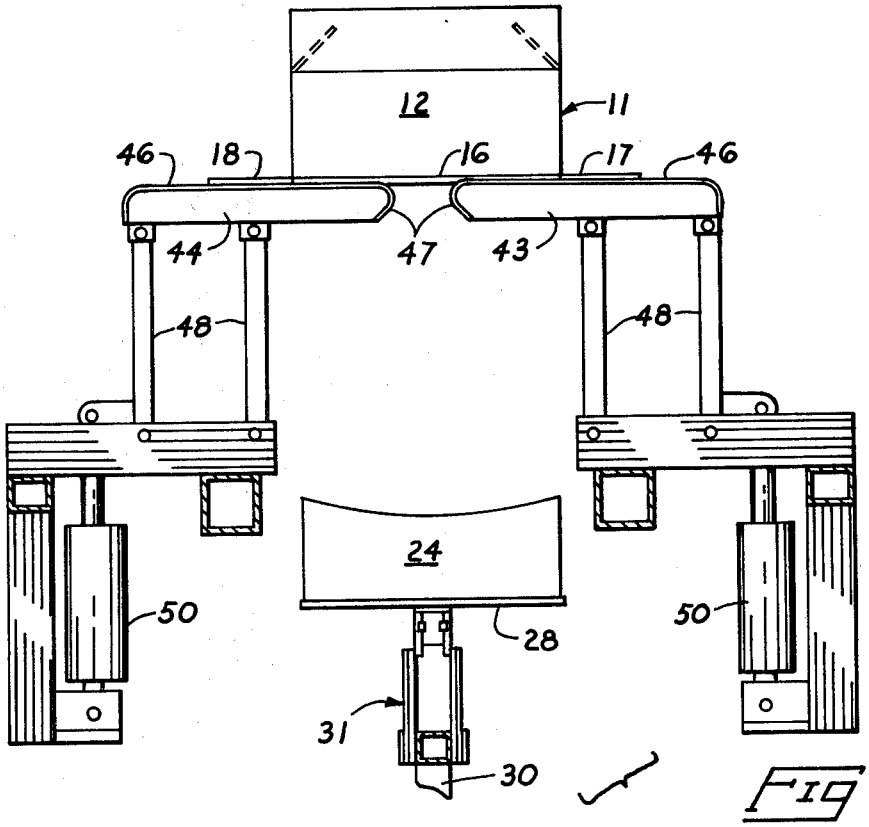
FIGS. 8 through 13 are schematic views showing the operation of the apparatus.
Figure 9:
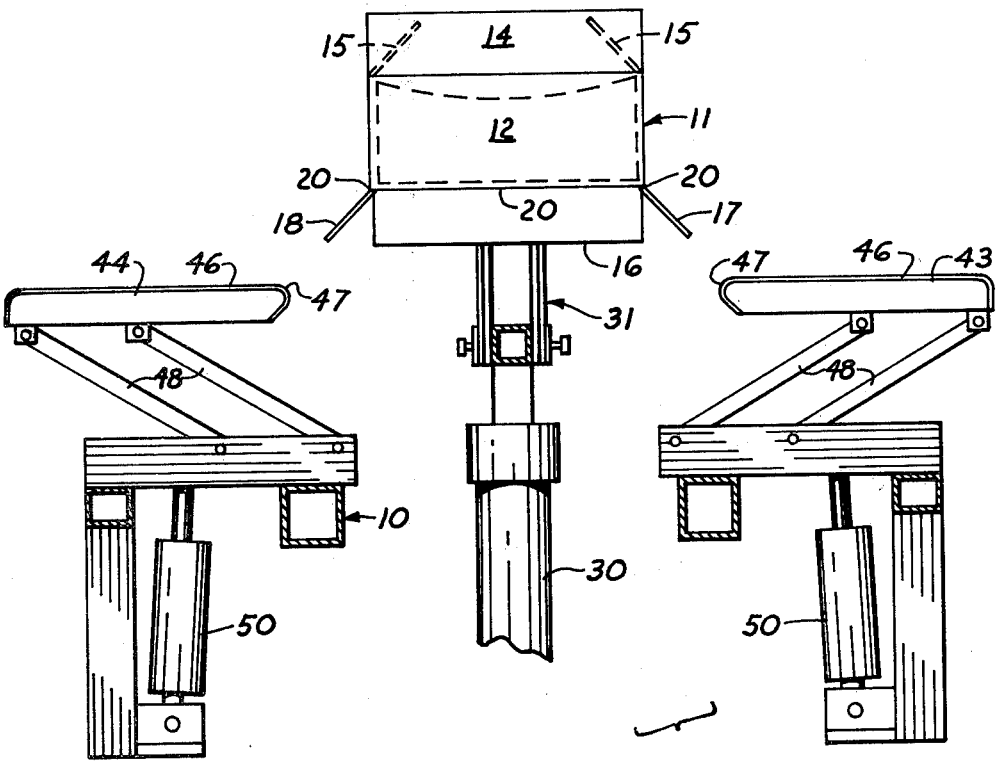
Figure 10:
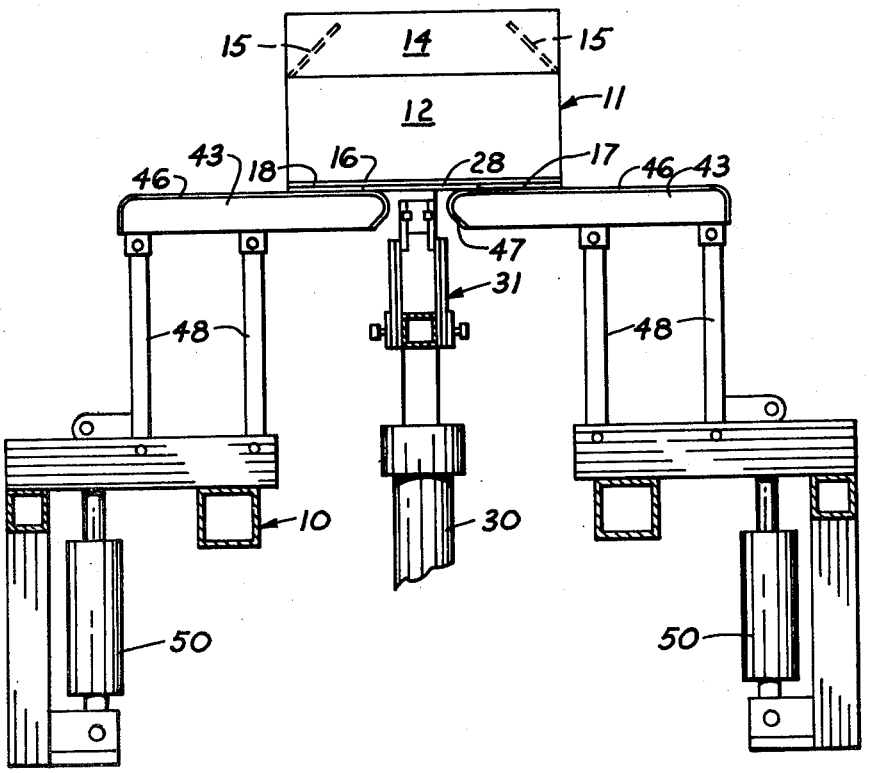
Figure 11:
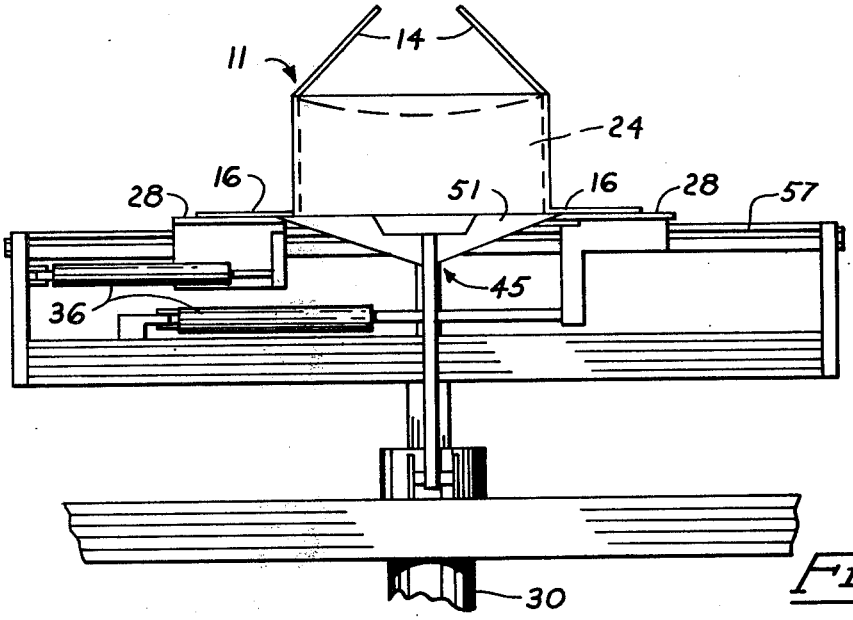

The sequence of operation for loading a case 11 at the packing station 8 is best understood from FIGS. 8 through 11. As previously described, case 11 remains stationary at the packing station and is held by the case conveyor and whatever auxiliary guides are desired. The front and rear flap engaging elements 43 are normally maintained in their raised positions as shown in FIGS. 8 and 10. They initially hold the front and rear lower flaps 17, 18 in substantially horizontal positions protruding to the front and rear of case 11 respectively. In addition, the lower side flaps 16 have been spread by passage across the plow 51 on the rear flap engaging element 44. Case 11 is therefore in readiness for reception of a load within it with a load 24 centered beneath the packing station on plates 28 (FIG. 8).

As the plates 28 are raised by the elevator cylinder 30, the cylinders 50 swing the front and rear flap engaging elements 43, 44 to the front and rear of the packing station respectively (FIG. 9). The front and rear flap engaging elements 43, 44 move in longitudinal directions opposite to one another to the spread condition shown in FIG. 9 in which they are located longitudinally outward from the respective front and rear flaps 17, 18 of the case 11 at the packing station 8. As soon as the plates 28 reach an elevation substantially coplanar to the bottom fold lines that join the bottom flaps to the case walls, the cylinders 50 are reversed to return the front and rear flap engaging elements 43, 44 to their raised position (FIG. 10). The upper surfaces 46 of the elements 43, 44 attain a coplanar condition which the front and rear flap engaging elements 43, 44 are located beneath and overlapping the raised position of the plates 28. The upward movement of the elements 43, 44 causes the inwardly facing noses 47 to push the flaps 17, 18 inward across the bottom of the case and against the lower surfaces of plates 28. The plates 28 are therefore sandwiched between the load 24 and the flaps 17, 18 which in turn are elevationally supported by the upper surfaces 46 of the coplanar elements 43, 44.

Plates 28 are stripped from under load 24 by operation of the cylinder assemblies 36 (FIG. 11) which spread them apart from one another to clear the flaps 17, 18. The spread plates 28 can then be lowered by the elevator cylinder 30 to their initial positions shown in FIG. 8. Plates 28 can be brought back to their normal abutting positions during elevational downward movement to their lowered condition.

Figure 12:
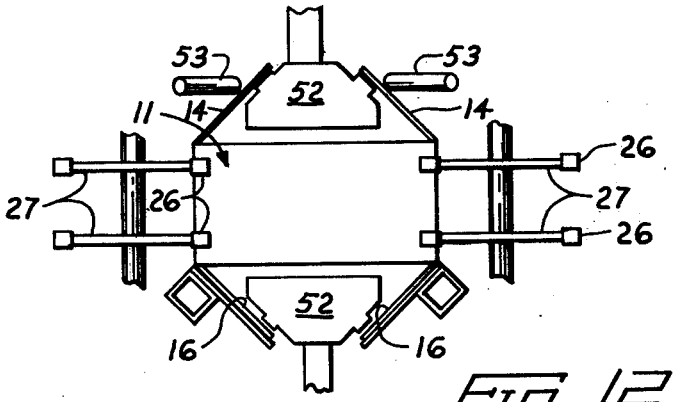
Figure 13:
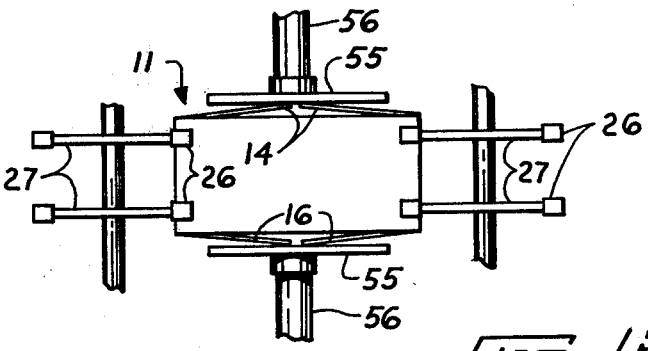

Completion of the case requires gluing of the flaps at the top and bottom of the case. This is accomplished by passing each case across upper and lower glue applicators shown generally at 52 (FIG. 12). The side flaps are held in a proper relationship with respect to the glue applicators by upper plows 53 and lower guides 54, the details of which are unimportant to an understanding of the present invention. The plows 53 and guides 54 subsequently cause the side flaps to be folded to horizontal positions as they approach the sealing station 9 (FIG. 13). At the station 9, opposed pressure plates 55 engage the top and bottom of the filled case to set the glue and seal the case. The pressure plates 55 are individually moved by conventional vertical cylinder assemblies 56.

The general method of filling a succession of open cases according to this disclosure relates to the steps of locating each case at a packing station, subsequently moving a load elevationally upward into each case on a thin plate structure, then folding a first pair of opposed flaps beneath the thin plate structure to a condition perpendicular to the walls from which they depend. The underside surfaces of the folded first pair of flaps is then vertically supported to permit horizontal withdrawal of the thin plate structure from the interior of the case. When the thin plate structure clears the folded first pair of flaps, the remaining pair of opposed flaps can be folded upon the first pair and sealed.

This provides effective means for loading fragile or unstable loads within a case by a bottom loading procedure. The general structure of this mechanism can be adapted to cases of any size and to various types and sizes of loads. The general mechanism shown and described above can be readily adapted to specific machinery installations wherein this method is applicable.

Having described my invention, I claim:

1. A packing apparatus for filling a succession of open cases each having front, rear and side flaps depending downward along coplanar bottom fold lines joining the respective flaps to upright walls, comprising:

case conveying means for moving the cases along a longitudinal path and sequentially locating each case at a packing station;

plate means for selectively supporting a load being placed within a case;

elevator means operably connected to said plate means for selectively moving said plate means between a lowered position beneath the packing station and a raised position substantially coplanar with the bottom fold lines of a case at the packing station;

front and rear flap engaging means;

power means operably connected to said front and rear flap engaging means for imparting movement to them in longitudinal directions opposite to one another between a spread condition in which the front and rear flap engaging means are located longitudinally outward from the respective front and rear flaps of a case at the packing station and a coplanar condition in which the front and rear flap engaging means are located beneath and overlapping the raised position of said plate means;

and plate shift means operably connected to said plate means for selectively moving said plate means within a plane parallel to the bottom fold lines of a case at the packing station between a first condition centered with respect to the case and a transversely spaced condition.

2. A packing apparatus as set out in claim 1 wherein said plate means comprises:

a pair of coplanar plates of thin sheet material having complementary inwardly facing edges opposed to one another;

a relatively narrow upright support framework beneath said plates and arranged perpendicular to their inwardly facing edges, said support framework being mounted to said elevator means;

individual guide means operably connected between each plate and the support of framework for limiting motion of each plate relative to the support framework to a direction perpendicular to its inwardly facing edge;

said plate shift means being operably connected to said guide means for imparting movement to the plates relative to the support framework in directions opposite to one another.

3. A packing apparatus for filling a succession of open cases each having front, rear and side flaps depending downwardly along coplanar bottom fold lines joining the respective flaps to upright walls, comprising:

case conveying means for moving the cases along a longitudinal path and sequentially locating each case at a packing station with the bottom fold lines thereof horizontal and the front and rear flaps thereof arranged transverse to said path;

plate means for selectively supporting a load being placed within a case, said plate means comprising a pair of coplanar thin horizontal plate elements separated along opposed inner longitudinal edges;

elevator means operably connected to said plate means for selectively moving said plate means between a lowered position beneath the packing station and a raised position substantially coplanar with the bottom fold lines of a case at the packing station;

front and rear flap engaging means;

power means operably connected to said front and rear flap engaging means for imparting movement to them in directions opposite to one another between a spread condition in which the front and rear flap engaging means are located longitudinally outward from the respective front and rear flaps of a case at the packing station and a coplanar condition in which the front and rear flap engaging means are located adjacent to one another beneath and overlapping the raised position of said plate means;

plate shift means operably connected between said elevator means and said plate elements for selectively moving the plate elements horizontally in opposite transverse directions relative to one another between a first condition in which the plate elements have their opposed inner longitudinal edges in juxtaposition to one another and a second condition in which said edges are transversely spaced apart.

4. A packing apparatus for filling a succession of open cases each having front, rear and side flaps depending downward along coplanar bottom fold lines joining the respective flaps to upright walls, comprising:

case conveying means for moving the cases along a longitudinal path and sequentially locating each case at a packing station;

front and rear flap engaging means for folding the respective front and rear flaps of a case at the packing station to positions outward from the upright walls from which they depend;

power means operably connected to said front and rear flap engaging means for imparting movement to them in longitudinal directions opposite to one another following reception of a case at the packing station to a spread condition in which they are located longitudinally outward from the respective front and rear flaps of the case;

plate means movable between a lowered position beneath the packing station and a raised position substantially coplanar with the bottom fold lines of a case at the packing station;

load conveying means for placing individual loads on said plate means while at said lowered position;

elevator means operably connected to said plate means for moving it from said lowered position to said raised position following movement of said front and rear flap engaging means to their spread condition;

said power means being further operable for imparting movement to said front and rear flap engaging means for causing them to engage and fold the respective front and rear flaps of a case at the packing station to positions inwardly perpendicular to the upright walls from which they depend and in abutment with said plate means as said front and rear flap engaging means move to positions beneath and overlapping the raised position of said plate means;

plate shift means operably connected to said plate means for selectively moving said plate means within a plane parallel to the bottom fold lines of a case at the packing station between a first condition centered with respect to the case and a transversely spaced second condition;

said elevator means being further operable for selectively initiating return of said plate means from its raised position to its lowered position while said plate means is in said second condition.

5. A packing apparatus for filling a succession of open cases each having flaps depending downward along coplanar bottom fold lines joining the respective flaps to upright walls, comprising:

case conveying means for moving the cases along a longitudinal path and sequentially locating each case at a packing station;

plate means for selectively supporting a load being placed within a case;

elevator means operably connected to said plate means for selectively moving said plate means between a lowered position beneath the packing station and a raised position substantially coplanar with the bottom fold lines of a case at the packing station;

and plate shift means operably connected to said plate means for selectively moving said plate means within a plane parallel to the bottom fold lines of a case at the packing station between a first condition centered with respect to the case and a transversely spaced condition;

said plate means comprising:

a pair of coplanar plates of thin sheet material having complementary inwardly facing edges opposed to one another;

a relatively narrow upright support framework beneath said plates and arranged perpendicular to their inwardly facing edges, said support framework being mounted to said elevator means;

individual guide means operably connected between each plate and the support of framework for limiting motion of each plate relative to the support framework to a direction perpendicular to its inwardly facing edge;

said plate shift means being operably connected to said guide means for imparting movement to the plates relative to the support framework in directions opposite to one another.

6. A method of filling an open case having front, rear and side flaps depending downward along coplanar bottom fold lines joining the respective flaps to upright walls, comprising the following steps:

conveying the open case along a longitudinal path transverse to its front and rear flaps;

locating the case in a stationary condition at a packing station along said path;

placing a load on a thin plate structure while at a first position elevationally beneath the packing station;

moving the load and thin plate structure elevationally upward into the case at said packing station;

folding and vertically supporting the front and rear flaps of the case beneath the thin plate structure while at said packing station;

horizontally withdrawing the thin plate structure from the stationary case at the packing station by withdrawing the thin plate structure transversely to each side of the case;

and subsequently imparting movement to the case and its contents outward from the packing station along said path.

7. A method as set out in claim 6 comprising the following additional step:

returning the thin plate structure to its first position subsequent to its withdrawal from the case.

8. A method as set out in claim 6 comprising the following additional step:

folding the side flaps of the case upwardly beneath its front and rear flaps as the case moves outward from the packing station.

* * * * *